United States Patent [19]

Chen et al.

[11] Patent Number: 5,067,205

[45] Date of Patent: Nov. 26, 1991

[54] STRUCTURE OF PAPER CLIP

[76] Inventors: Chun-Hui Chen, No. 132-3, Tu-Cheng Rd., Chin-Cheng Tsun, Ta-Li Hsiang, Taichung Hsien; Guu-Trang Lin, No. 198, Sec. 3, Ching-Tao Rd., Taichung, both of Taiwan

[21] Appl. No.: 588,727

[22] Filed: Sep. 27, 1990

[51] Int. Cl.[5] ..... B42F 1/02

[52] U.S. Cl. ..... 24/67.9; 24/546

[58] Field of Search ..... 24/67.9, 67 R, 67.3, 24/546, 551

[56] References Cited

U.S. PATENT DOCUMENTS

| | | | |
|---|---|---|---|
| 384,293 | 6/1888 | Snedden | 24/551 |
| 1,417,850 | 5/1922 | Marshall | 24/551 |
| 2,781,566 | 2/1957 | Hammer | 24/67.9 |
| 3,083,425 | 4/1963 | Minnerly, Jr. | 24/67.9 |
| 3,217,369 | 11/1965 | Sacean | 24/546 |
| 4,918,789 | 4/1990 | Chen et al. | 24/67.9 |

*Primary Examiner*—Victor N. Sakran

*Attorney, Agent, or Firm*—Bacon & Thomas

[57] ABSTRACT

A paper clip made of a resilient steel wire bent into shape, which comprises two front bends disposed at same plane and formed into a clamping portion for holding sheets of paper inserted therebetween, and an unitary wave-like back bend substantially perpendicular to the two front bends and forming a stop portion for stopping the paper which is fastened in the clamping portion. The wave-like back bend is formed of at least one peak and one wave trough so as to provide stronger tensile elasticity permitting the clamping portion to tightly retain more sheets of paper.

4 Claims, 2 Drawing Sheets

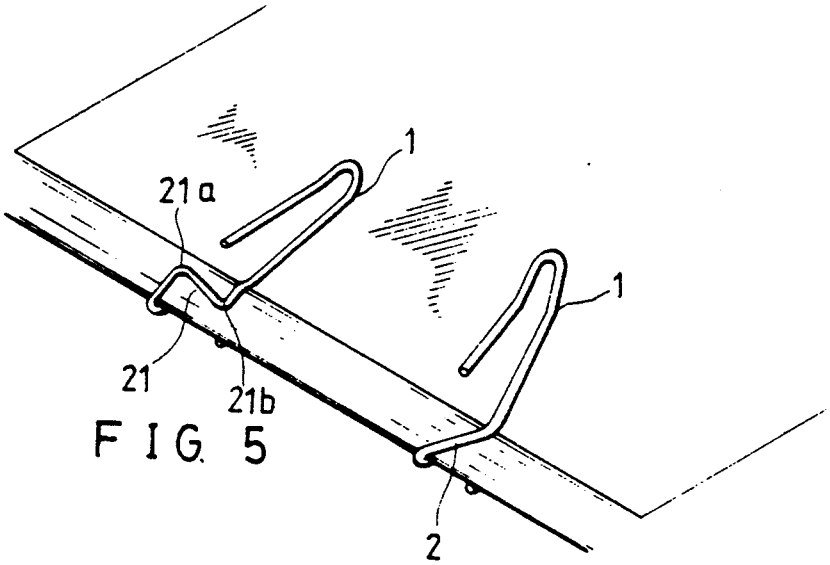
FIG. 5
FIG. 2
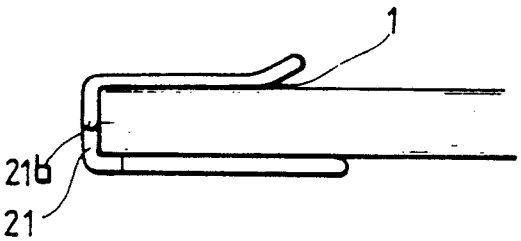
FIG. 6
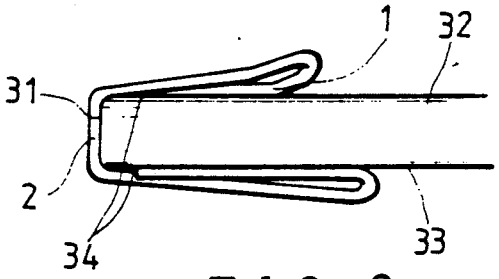
FIG. 3
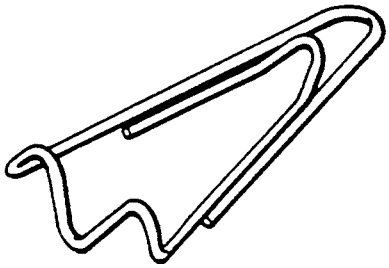
FIG. 7

STRUCTURE OF PAPER CLIP

BACKGROUND OF THE INVENTION

The present invention is related to paper clips, and more particularly to a paper clip which has a wave-like paper stop portion substantially perpendicular to the paper clamping portion thereof to improve the tensile elasticity of the paper clamping portion for tightly holding more sheets of paper at a time.

A conventional paper clip is generally made of a resilient steel wire bent through 540° angle or more on a plane into a shape as shown in FIG. 1, in which the two bends which are disposed in same direction form a paper clamping portion (1) for holding sheets of paper (3), the other bend which is disposed substantially in vertical to the paper clamping portion (1) forms a paper stop portion (2) for stopping the edge 31 of the paper (3) which is fastened therein. Because the two opposite ends of the paper stop portion (2) are respectively merged into the paper clamping portion (1), the clip may be distorted easily when the paper clamping portion (1) is opened for holding a pile of sheets of paper (see FIG. 2). Referring to FIG. 3, when the paper clamping portion (1) is opened for holding a pile of sheets of paper (3), it can only clamp on the two opposite surfaces (32), (33) of the paper (3) at a position (34) near the edge (31) which is stopped at the paper stop portion (2). When more sheets of paper (3) are clamped, the position 34 will become closer to the edge (31) to badly affect the chucking work of the clip on the paper (3).

SUMMARY OF THE INVENTION

The present invention has been accomplished to eliminate the aforesaid problems. It is one object of the present invention to provide a paper clip which provides improved tensile elasticity for tightly holding more sheets of paper at a time.

According to the present invention, a paper clip is made of a resilient steel wire bent into shape, which comprises two front bends disposed in one direction and forming a clamping portion for holding sheets of paper inserted therebetween, and an unitary wave-like back bend substantially perpendicular to the two front bends and forming a stop portion for stopping the paper which is fastened in the clamping portion. The wave-like back bend is formed of at least one peak and one wave trough so as to provide stronger tensile elasticity permitting the clamping portion to tightly retain more sheets of paper.

BRIEF DESCRIPTION OF THE DRAWINGS

The present invention will now be described by way of examples with reference to the annexed drawings, in which:

FIG. 2 illustrates the use of the paper clip of FIG. 1 in holding a pile of sheets of paper;

FIG. 3 is a side view of FIG. 2;

FIG. 5 illustrates the use of the preferred embodiment of the present invention in holding a pile of sheets of paper;

FIG. 6 is a side view of FIG. 5;

FIG. 7 illustrates an alternate form of the present invention.

DETAILED DESCRIPTION OF THE PREFERRED EMBODIMENTS

Figure 1:
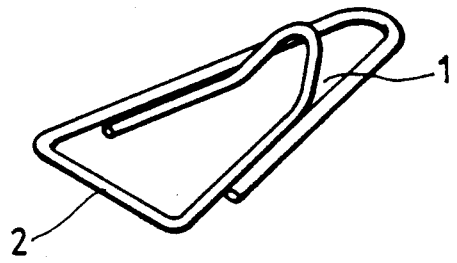
FIG. 1 PRIOR ART
FIG. 1 illustrates a paper clip constructed according to the prior art.
Figure 4:
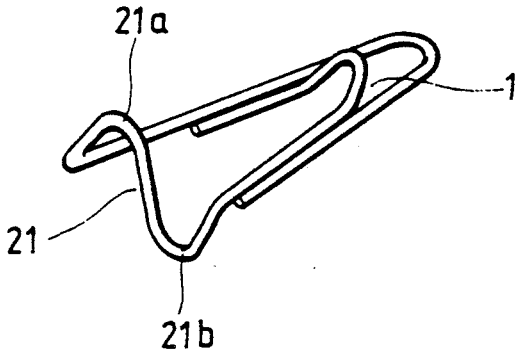
FIG. 4 illustrates a paper clip embodying the present invention.

Referring to FIG. 4, therein illustrated is a paper clip embodying the present invention, which is generally made of a resilient steel wire bent into shape, in which the two bends which are disposed at the front and in same direction to form a paper clamping portion 1 for holding sheets of paper 3, the other bend which is disposed at the back and substantially perpendicular to the paper clamping portion 1 is further bent into a wave-like paper stop portion 21 disposed longitudinally at the same plane for stopping the edge 31 of the paper 3 which is fastened therein.

Referring to FIG. 5, because the wave-like paper stop portion 21 is formed by bending a resilient steel wire into at least one peak 21*a* and one wave trough 21*b* respectively disposed at the same vertical plane not in parallel with but substantially perpendicular to the paper clamping portion 1, it provides improved tensile elasticity so that the paper clamping portion 1 can be resiliently opened wider for tightly holding more sheets of paper.

Referring to FIG. 6, the improved tensile elasticity of the wave-like paper stop portion 21 permits the two front bends of the paper clamping portion 1 to entirely respectively attach to the top and bottom surfaces 32, 33 of the pile of sheets of paper 3 which is inserted therein, so that the pile of sheets of paper 3 can be firmly retained.

Referring to FIG. 7, therein illustrated is an alternate form of the present invention, in which the wave-like paper stop portion 1 is comprised of a plurality of peaks 21*a* and wave troughs 21*b*. According to test, the more the peaks 21*a* and the wave troughs 21*b* are formed, the stronger the tensile elasticity of the wave-like paper stop portion 1 will be. Therefore, when more peaks 21*a* and wave troughs 21*b* are formed in a wave-like paper stop portion 1, more sheets of paper can be firmly retained in clip.

As described in the foregoing statement, the present invention is to provide a paper clip with improved tensile elasticity for holding more sheets of paper at a time, which can be variously embodied. Recognizing that various modifications are apparent, the scope herein shall be deemed as defined in the claims set forth hereinafter.

We claim:

1. A paper clip including a front end and a back end, the clip being formed of resilient steel wire bent to define first and second bend portions extending in the same direction toward the front end for clamping paper therebetween, the first and second bend portions being collectively disposed in a first single plane, a third bend portion joining the first and second bend portions at the back end, the third bend portions being of a wave configuration defined by at least one peak portion and one trough portion, the third bend portion being disposed in a second single plane perpendicular to the first single plane, whereby the third bend permits the first and second bend portions to securely clamp a pile of paper sheets therebetween such that each of the first and second bend portions substantially entirely engages the top and bottom surfaces of the stack.

2. The paper clip of claim 1 wherein the resilient steel wire is bent continuously through a 540° angle to integrally form the first and second bend portions.

3. The paper clip of claim 1 wherein the resilient steel wire is bent non continuously through a 540° angle to integrally form the first and second bend portions.

4. The paper clip of claim 1 further including a wave configuration defined by a plurality of peak portions and a plurality of trough portions.

* * * * *